US005793156A

United States Patent [19]

Han et al.

[11] Patent Number: 5,793,156

[45] Date of Patent: Aug. 11, 1998

[54] COLOR CATHODE RAY TUBE

[75] Inventors: Dong-hee Han; Hwan-chul Rho; Jae-myung Kim, all of Suwon, Rep. of Korea

[73] Assignee: SamSung Display Devices Co., Ltd., Kyungki-do, Rep. of Korea

[21] Appl. No.: 775,036

[22] Filed: Dec. 30, 1996

[30] Foreign Application Priority Data

Dec. 30, 1995 [KR] Rep. of Korea ..... 1995-69771

[51] Int. Cl.[6] ..... H01J 29/81

[52] U.S. Cl. ..... 313/407; 313/402; 313/408

[58] Field of Search ..... 313/402, 407, 313/408

[56] References Cited

U.S. PATENT DOCUMENTS 5,594,300 1/1997 Nosker et al. ..... 313/407

*Primary Examiner*—Nimeshkumar Patel

*Attorney, Agent, or Firm*—Lowe Hauptman Gopstein & Berner

[57] ABSTRACT

A color cathode ray tube in which the structure of a shadowmask frame assembly is improved. The color cathode ray tube includes a panel, a funnel sealingly coupled to the panel, an electron gun installed in a neck portion of the funnel, a deflection yoke installed around a conical portion of the funnel, a shadowmask frame assembly including a shadowmask in which a multiplicity of electron beam passing holes are formed and a frame installed at an inner edge of the panel for supporting the shadowmask, and a heater for thermally expanding the frame in the same direction as the thermal expansion direction of the shadowmask. According to the color cathode ray tube, it is possible to stabilize an initial screen.

10 Claims, 4 Drawing Sheets

COLOR CATHODE RAY TUBE

BACKGROUND OF THE INVENTION

The present invention relates to a color cathode ray tube, and more particularly, to a color cathode ray tube in which the structure of a shadowmask frame assembly is improved.

An example of a general color cathode ray tube is shown in FIGS. 1 and 2. This color cathode ray tube includes: a panel 10 on the inner surface of which is formed a fluorescent film 11; a shadowmask frame assembly 20 supported by the inside of the panel 10; and a funnel 30, sealingly coupled with the panel 10, and having a neck portion 31 wherein an electron gun 40 is installed and a coned portion 32 around which a deflection yoke 50 is installed.

The shadowmask frame assembly 20 includes a shadowmask 21 separated from the fluorescent film 11 by a predetermined distance and a frame 22 for supporting the shadowmask 21 and is combined to a stud pin 12 fixed to an inner edge of the panel 10 through a spring **22*a* installed at a side of the frame 22**.

In the color cathode ray tube having the structure described above, electron beams emitted from the electron gun 40 are selectively deflected by the deflection yoke 50. The deflected electron beams form an image by landing on respective fluorescent points of the fluorescent film 11 passing through electron beam passing holes **21*c* formed in the shadowmask 21**.

As the electron beams emitted from the electron gun 40 form an image by landing on the fluorescent film, not all of the electron beams emitted from the electron gun 40, namely, thermal electrons, pass through the electron beam passing holes **21*c* of the shadowmask 21. That is to say, only 15% to 18% of the electron beams pass through the electron beam passing holes 21*c* of the shadowmask 21 and the rest collide with the shadowmask 21. Accordingly, the shadowmask 21 supported by the frame 22 is heated and there is thermal expansion in a relatively short time compared with the frame 22 due to collisions of the electron beams which do not pass through the electron beam passing holes with the shadowmask. Most of the thermal expansion of the shadowmask 21 is absorbed in a holed portion 21*b* in which the electron beam passing holes 21*c* are formed since a skirt portion 21*a* of the shadowmask 21 is soldered to the frame 22 as shown in FIG. 2, thus causing a doming phenomenon in which the holed portion 21*b*** swells.

Such a doming phenomenon of the holed portion **21*b* changes the relative positions of the electron beam passing holes 21*c* formed in the holed portion 21*b* with respect to the pixels of the fluorescent film 11 formed inside the panel. Since an electron beam B emitted from the electron gun 40 drifts from P1 to P2 of the fluorescent film 11 as shown in FIG. 3 due to the displacement of the electron beam passing holes 21*c* with respect to the fluorescent film 11, the electron beam does not land precisely on the respective fluorescent points of the fluorescent film 11**, thus deteriorating resolution of the picture and causing color spread.

The above doming phenomenon of the shadowmask is partially compensated for since heat is transmitted from the shadowmask 21 to the frame 22 with a lapse in time and the frame 22 thermally expands, thus the swelling of the shadowmask holed portion **21*b* is reduced. The amount of doming quantity which is not compensated for by the thermal expansion of the frame 22 is compensated for by the spring 22*a* installed at the side of the frame 22**.

Compensation for the doming of the shadowmask 21 by the thermal expansion of the frame 22 and the spring **22*a* takes more time than heating the shadowmask. Since the initial doming phenomenon of the shadowmask 21 occurs within about 1 to 2 minutes, the initial doming phenomenon cannot be compensated for by the frame 22 and the spring 22*a*** which thermally expands with time.

SUMMARY OF THE INVENTION

It is an object of the present invention to provide a color cathode ray tube having a shadowmask frame assembly in which an initial doming of a shadowmask due to thermal expansion can be compensated for in a short time.

To achieve the above object, there is provided a color cathode ray tube, comprising a panel, a funnel sealingly coupled to the panel, an electron gun installed in a neck portion of the funnel., a deflection yoke installed around a coned portion of the funnel, a shadowmask frame assembly including a shadowmask in which a multiplicity of electron beam passing holes are formed and a frame installed at an inner edge of the panel for supporting the shadowmask, and heating means for thermally expanding the frame in the thermal expansion direction of the shadowmask.

In the present invention, the heating means preferably includes a heater installed at a surface of the frame.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
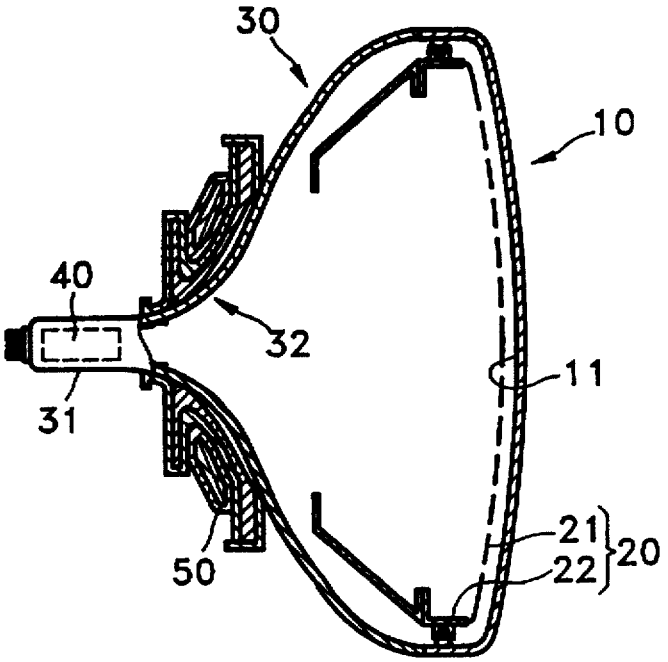
FIG. 1 is a sectional view of a general color cathode ray tube.
Figure 3:
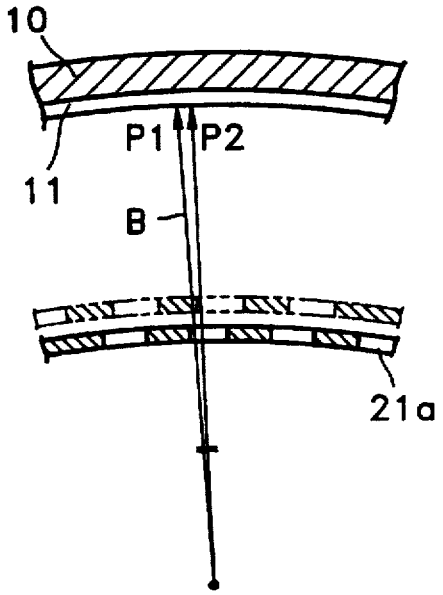
FIG. 3 (PRIOR ART)
FIG. 3 shows an electron beam drifting due to a doming phenomenon of a shadowmask.
Figure 2:
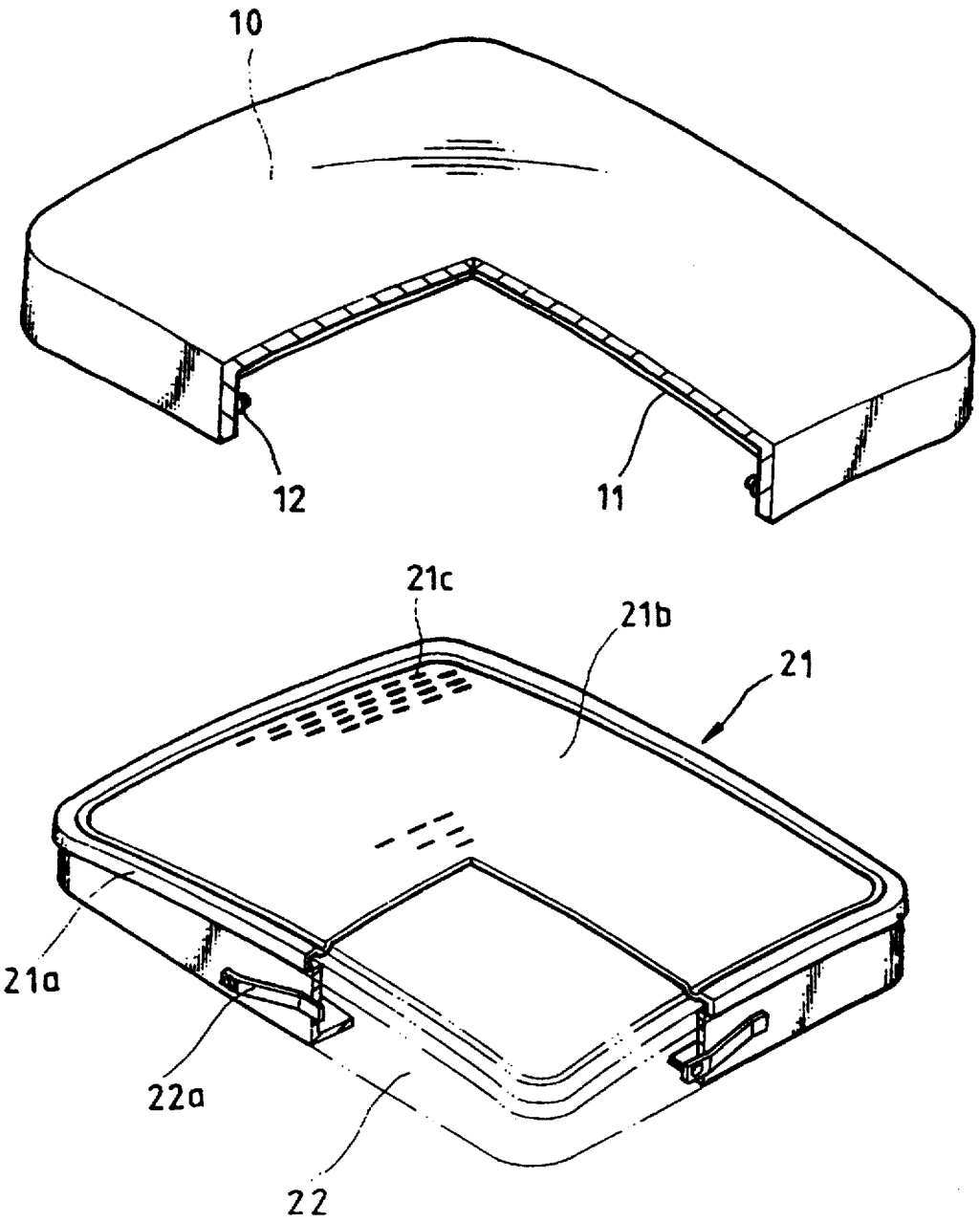
FIG. 2 (PRIOR ART)
FIG. 2 is a partially exploded perspective view showing the state of a conventional shadowmask frame assembly loaded inside a panel.
Figure 4:
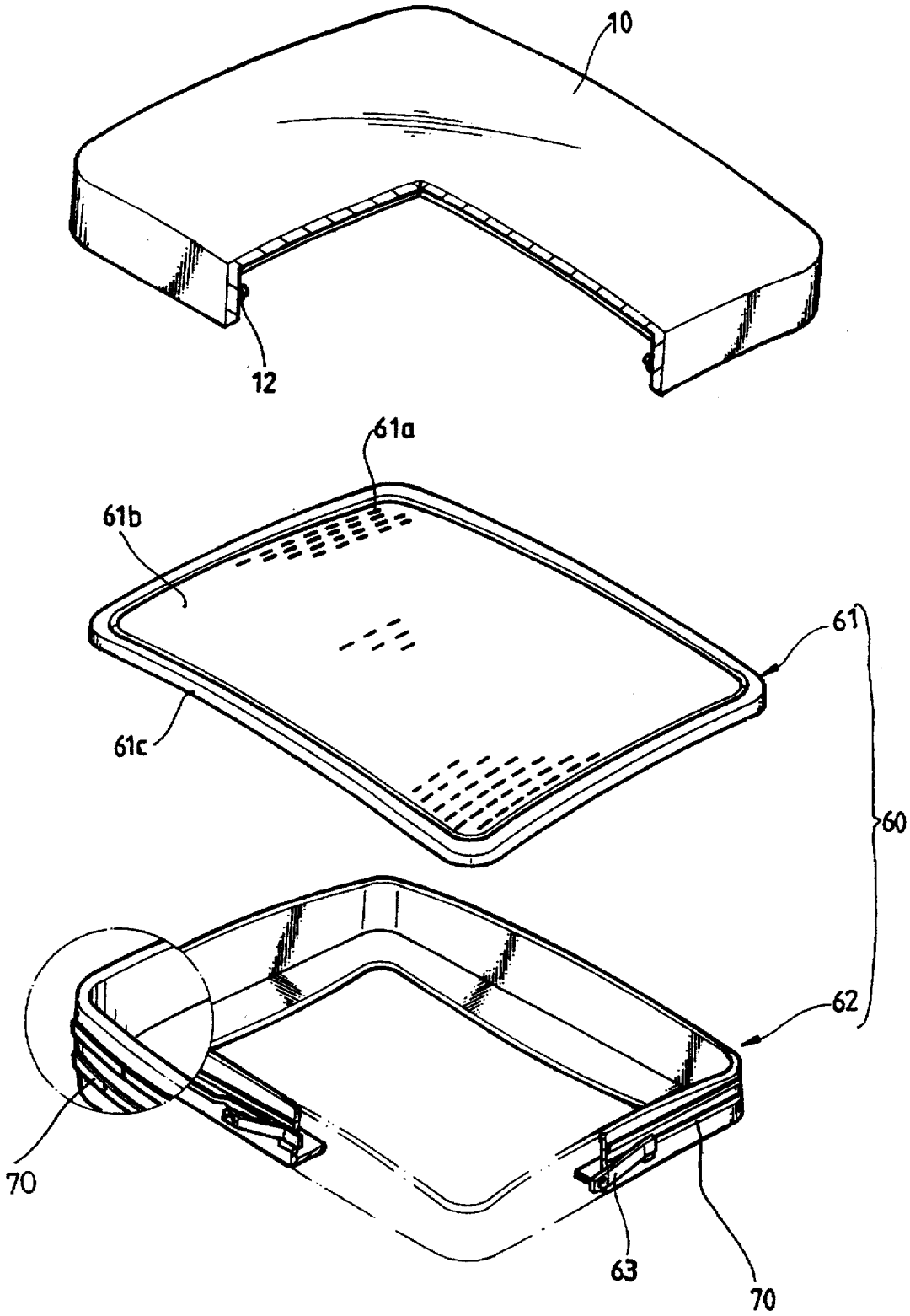
FIG. 4 is a partial exploded perspective view showing a state in which a shadowmask frame assembly is loaded inside a panel in a color cathode ray tube according to the present invention.

A color cathode ray tube according to the present invention includes: a panel 10 on the inner surface of which is formed a fluorescent film 11; a shadowmask frame assembly 60 supported by the inside of the panel 10; and a funnel 30, sealingly coupled with the panel 10, and having a neck portion 31 wherein an electron gun 40 is installed and a coned portion 33 around which a deflection yoke 50 is installed.

The shadowmask frame assembly 60 includes a shadowmask 61 having a holed portion **61*b* in which a multiplicity of electron beam passing holes 61*a* are formed and a skirt portion 61*c*, a frame 62 combined to the skirt portion 61*c* of the shadowmask 61, and a spring 63 installed at the edge of the frame 62 and combined to a stud pin 12 of the panel 10. A heater 70 as a heating means is installed in the frame 62. The heater 70 is installed on the surface of the frame 62. The heater 70 is preferably as a thin plate type so as not to protrude beyond the surface when attached to the frame 62**.

A voltage obtained by reducing an anode voltage applied from the outside to the frame 62 and a voltage applied to an electrode of the electron gun is preferably applied to the heater 70.

The operation of the color cathode ray tube according to the present invention will now be described.

As electron beams are emitted from the electron gun 40 the shadowmask is heated and there is thermal-expansion. Namely, some of the thermal electrons which do not pass through the electron beam passing holes 61*a* of the shadowmask 61 collide with the shadowmask 61, thereby generating heat. In order to prevent a doming phenomenon in the holed portion 61*b* of the shadowmask 61 due to a thermal transfer time lag between the shadowmask 61 and the frame 62, the heater 70 heats the frame 62 in a relatively short time, thereby expanding the frame 62 to compensate for the doming phenomenon.

Figure 5:
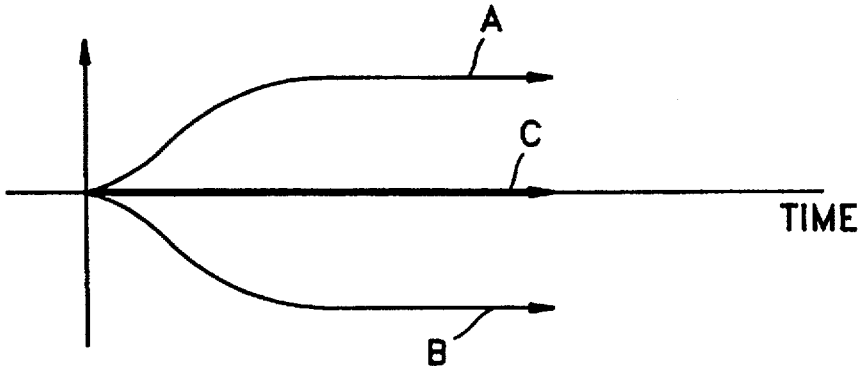
FIG. 5 is a graph for showing the thermal expansion of a shadowmask and a frame.

This procedure is described in greater detail as follows. Before heat generated by collisions of the thermal electrons with the shadowmask 61 is transferred to the frame 62, a predetermined voltage is supplied to the heater 70, thus heating the frame 62. The doming phenomenon of the holed portion 61*b* caused by the thermal expansion of the shadowmask 61 can be compensated for by the thermal expansion of the frame 62 as described above. At this time, while the doming (the graph A) is generated by the thermal expansion of the shadowmask 61, as shown in FIG. 5, the frame 62 is heated by the heater 70 and is expanded in the same direction as the direction of the expansion of the shadowmask 61. Therefore, the amount of thermal expansion of the shadowmask 61 is offset by the thermal expansion of the frame 62, thus maintaining a balance in a short amount of time. That is to say, since the shadowmask 61 and the frame 62 are thermally expanded in the same direction at the same time, the doming phenomenon of the shadowmask is prevented.

Alternatively, in the case of heating the frame 62 prior to driving the cathode ray tube, the distance between the holed portion 61*b* of the shadowmask 61 and the fluorescent film 11 is relatively enlarged due to the thermal expansion of the frame 62, and then the shadowmask 61 heated by the collision of the thermal electrons is thermal-expanded within 1 to 2 minutes, thus the distance between the shadowmask 61 and the fluorescent film 11 is kept as desired.

The initial doming phenomenon of the shadowmask 61 is compensated for and the time for stabilizing an initial screen formed on the panel of the cathode ray tube is reduced according to the above-described operation, thus preventing distortion of picture and color spread.

In the color cathode ray tube according to the present invention, a thermal drift phenomenon of the electron beam passing holes can be prevented by compensating for the doming of the shadowmask caused by thermal expansion in an initial stage and the initial stabilizing time of the picture can be reduced, thus improving the resolution of the picture.

The present invention has been explained with regard to an example of compensating for doming of the shadowmask by heating the frame by a heater. However, the present invention is not restricted to the above embodiments and it is understood that many variations are possible within the scope and spirit of the present invention by anyone skilled in the art.

What is claimed is:

1. A color cathode ray tube, comprising:

a panel;

a funnel coupled to said panel;

an electron gun installed in a neck portion of said funnel;

a deflection yoke installed around a conical portion of said funnel;

a shadowmask frame assembly including a shadowmask having a multiplicity of electron beam passing holes and a frame installed at an inner edge of said panel, said frame supporting said shadowmask; and a heating device attached to said frame.

2. A color cathode ray tube as claimed in claim 1, wherein said heating device comprises a heater installed at a surface of said frame.

3. A color cathode ray tube as claimed in claim 2, wherein said heater is of a thin plate type.

4. A color cathode ray tube as claimed in claim 2, wherein said heater is installed such that said heater does not protrude from the surface of said frame.

5. A color cathode ray tube as claimed in claim 3, wherein said heater is installed such that said heater does not protrude from the surface of said frame.

6. A color cathode ray tube as claimed in claim 1, wherein said shadowmask and said frame thermally expand in a same direction.

7. A color cathode ray tube as claimed in claim 1, wherein the coupling between said funnel and said panel is sealed.

8. A method of counteracting a doming phenomenon in a color cathode ray tube having an electron gun, and a shadowmask frame assembly including a shadowmask having a multiplicity of electron beam passing holes and a frame for supporting the shadowmask, said method comprising the steps of:

heating the frame to cause the frame to expand; and emitting electron beams from the electron gun towards the shadowmask, thereby causing the shadowmask to expand.

9. The method of counteracting a doming phenomenon in a color cathode ray tube according to claim 8, wherein the step of heating the frame includes supplying a predetermined voltage to a heater attached to the frame.

10. The method of counteracting a doming phenomenon in a color cathode ray tube according to claim 8, wherein said shadowmask and said frame thermally expand in a same direction.

* * * * *